United States Patent [19]

Maddever et al.

[11] 4,397,685

[45] Aug. 9, 1983

[54] PRODUCTION OF ULTRA LOW CARBON STEEL BY THE BASIC OXYGEN PROCESS

[75] Inventors: Wayne J. Maddever, Pleasantville, N.Y.; Michael T. Burns, Middletown, Ohio; Jennings B. Lewis, Putnam Valley, N.Y.

[73] Assignee: Union Carbide Corporation, Danbury, Conn.

[21] Appl. No.: 362,050

[22] Filed: Mar. 26, 1982

[51] Int. Cl.[3] ..... C21C 5/32; C21C 5/34

[52] U.S. Cl. ..... 75/60; 75/59

[58] Field of Search ..... 75/60, 59

[56] References Cited

U.S. PATENT DOCUMENTS

| | | | |
|---|---|---|---|
| 3,854,932 | 12/1974 | Bishop | 75/60 |
| 3,867,134 | 2/1975 | Shaw | 75/60 |
| 4,178,173 | 12/1979 | Gorges | 75/59 |

*Primary Examiner*—P. D. Rosenberg

*Attorney, Agent, or Firm*—Stanley Ktorides

[57] ABSTRACT

Low alloy steel having an ultra low carbon content is produced using the basic oxygen process wherein an inert gas is introduced into the melt when the melt has a carbon content below about 0.06 weight percent, the oxygen flowrate is adjusted to from 10 to 40 percent of the inert gas flow rate and the oxygen lance height is reduced to from 30 to 60 percent of the normal lance height.

8 Claims, No Drawings

PRODUCTION OF ULTRA LOW CARBON STEEL BY THE BASIC OXYGEN PROCESS

TECHNICAL FIELD

This invention relates, in general, to refining of steel and more particularly, to an improvement in the basic oxygen process wherein molten steel contained in a vessel is refined by top blowing oxygen into the melt, i.e., by injecting oxygen into the melt from above the surface of the melt.

BACKGROUND ART

The manufacture of steel by the basic oxygen process, commonly referred to as the BOP or BOF process, is well known and widely used in the art. However, one problem with the conventional basic oxygen process when production of low alloy steel having a low carbon content is desired is the increasing quantity of oxygen that reacts with the metal rather than with the carbon as the carbon content decreases. Metallic oxidation results in loss to the slag of valuable elements such as iron and manganese. Such metallic oxidation is also costly because oxygen is consumed in excess of the steel making requirements. Furthermore, oxidation of other metallic alloying materials may result in a deterioration in the quality of the steel and necessitate costly and time consuming post-decarburization procedures. Excess metallic oxidation will also increase the temperature of the melt and the oxide content of the slag both of which are detrimental to the refractory lining of the refining vessel. All of these problems reduce the efficiency of the BOF process.

The problems described above are exacerbated when steel having an ultra low carbon content, i.e., 0.02 weight percent or less, is desired.

Recently, there have been reported processes for the production of ultra low carbon steel by use of a top blowing process in combination with some form of oxygen and/or inert gas injection from beneath the melt surface. This may be undesirable because retrofit of a top-blowing BOF facility to be compatible with a bottom blowing processes is very costly.

Accordingly it is an object of this invention to provide an improved basic oxygen process for the production of low alloy steel.

It is another object of this invention to provide an improved basic oxygen process for the production of low alloy steel having an ultra low carbon content.

It is a further object of this invention to provide an improved basic oxygen process for the production of ultra low carbon low alloy steel while reducing the amount of iron and other metals oxidized into the slag thus improving the yield of the process and resulting in a more efficient process.

It is still another object of this invention to provide an improved basic oxygen process for the production of ultra low carbon low alloy steel while reducing the high melt temperatures normally associated with the making of these steels by the conventional basic oxygen process.

It is still another object of this invention to provide an improved basic oxygen process for the production of ultra low carbon low alloy steel while avoiding the need to also inject oxygen or other gases into the melt from below the melt surface.

DISCLOSURE OF THE INVENTION

The above and other objects which will become apparent to one skilled in the art are achieved:

In a process for the production of low alloy steel comprising decarburizing a ferrous melt contained in a vessel by injecting oxygen through a lance into the melt from above the surface of the melt, the improvement whereby low alloy steel having an ultra low carbon content is produced comprising the steps of:

(a) injecting an inert gas into the melt from above the surface of the melt at a flow rate of from about 40 to 110 percent of the oxygen lance ratio when the carbon content of the melt is less than about 0.06 weight percent;

(b) adjusting the flow of oxygen through the lance to be from about 10 to 40 percent of the inert gas flow rate;

(c) lowering the lance height to between about 30 to 60 percent of the normal lance height;

and (d) continuing the injection of oxygen and inert gas into the melt until low alloy steel having the desired ultra low carbon content is produced.

The term, ultra low carbon steel, is used in the present specification and claims to mean steel having a carbon content which is generally less than about 0.02 weight percent.

The term, low alloy steel, is used in the present specification and claims to mean steel having a chromium content which is generally less than about 5 weight percent.

The term, normal lance height, is used in the present specification and claims to mean the normal distance between the lance tip from which the gas emerges and the surface of the melt during the latter stage of decarburization. This distance is generally from about 30 to 40 oxygen nozzle diameters. As is known in the art, all BOP shops have normal lance positions for various stages of conventional oxygen decarburization.

The term, decarburization, is used in the present specification and claims to mean the removal of carbon from a steel melt by the injection of oxygen into the melt and the reaction of carbon with oxygen to form carbon monoxide which then bubbles through and out of the melt.

The term, oxygen lance rating, is used in the present specification and claims to mean the oxygen flowrate which the lance is designed to deliver. As is well known in the art, all oxygen lances used in BOF steelmaking have an oxygen flowrate rating.

Unless otherwise specified, all percentages of carbon and solids are weight percentages.

DETAILED DESCRIPTION

In the practice of this invention a steel melt may be decarburized using conventional basic oxygen practice until the carbon content of the melt has been reduced to below about 0.06 percent; preferably the melt carbon content is not below 0.03 percent. Any of the known methods of decarburizing a steel melt may be employed to obtain a melt having a carbon content of less than about 0.06 weight percent. Generally a steel melt will have a carbon content prior to decaburization of from about 1 to 2 percent.

When the melt has to a carbon concentration of less than about 0.06 percent the inert gas injection is begun. The inert gas is injected at a flow rate of from about 40 to 110 percent of the flowrate rating of the oxygen lance. It is generally more preferable to inject the inert gas at the highest obtainable flowrate consistent with the process of this invention although as is well known the greater the amount of inert gas employed the greater generally will be the cost of the process due to inert gas usage.

The inert gas is preferably introduced into the melt though the oxygen lance, most preferably admixed with oxygen. However, if desired, the inert gas may be introduced into the melt through a separate lance. When the inert gas is introduced into the melt through a separate lance it should be introduced in such a way so that it impacts the melt in essentially the same area as the oxygen impacts the melt.

The inert gas useful in the process of this invention may be any non-oxygen containing gas which does not react with the constituents of the melt. Among such gases one can name argon, nitrogen, krypton, xenon and the like. Preferably the inert gas is a relatively heavy gas. A preferred inert gas is argon. Nitrogen is also preferred unless low nitrogen steel is desired.

When the melt has a carbon content of less than about 0.06 percent the oxygen flow through the lance is adjusted to from about 10 to 40 percent, preferably to from about 15 to 25 percent, of the inert gas flow rate.

As is known to those skilled in the art, the total flow rate of gas through the oxygen lance generally should not exceed about 120 percent of the oxygen lance rating.

When the melt has a carbon content of less than about 0.06 percent, the oxygen lance height is lowered to between about 30 to 60 percent of the normal lance height. The normal lance height is the height normally used during the latter stages of decarburization and is generally from 30 to 40 oxygen nozzle diameters above the melt surface.

The three steps discussed above, the initiation of inert gas flow, the adjustment of the oxygen flowrate and the lowering of the lance may occur simultaneously or in any order although it is preferred that the oxygen flowrate be adjusted prior to or simultaneously with the lowering of the lance so as to avoid possible damage to the lance.

The inert gas blow with the adjusted oxygen flowrate at the lowered lance position continues until ultra low carbon steel is produced. Applicants have found that in actual practice the time required to achieve ultra low carbon steel while carrying out the defined inert gas blow and oxygen blow at the lowered lance position is generally between 3 and 8 minutes.

By the use of the process of this invention one can now efficiently produce ultra low carbon steel by the BOF process. As is well known in the art, as the carbon content of the melt decreases it becomes more and more difficult to remove the remaining carbon without also oxidizing metallic constitutuents of the melt. The process of this invention reduces the fraction of oxygen injected into the melt when the carbon content has been reduced to a relatively low value, thus reducing the tendency toward unwanted metallic oxidation. The injection of inert gas into the melt with the oxygen forms bubbles in the melt comprised primarily of inert gas but containing some carbon monoxide due to the reaction of oxygen with the carbon in the melt. The low partial pressure of the carbon monoxide in the bubble acts to draw carbon monoxide from the melt into the bubble. This serves to enhance the thermodynamic drive of the reaction between oxygen and carbon in the melt and thus effectively removes carbon from the melt. The inert gas bubbles containing the carbon monoxide then bubble through and out of the melt.

It is important that the inert gas and the oxygen be injected so that they impact the melt in essentially the same area. Thus it is preferred that they both be injected through the oxygen lance and most preferably admixed in the oxygen lance. It was found that an inert gas bubble containing some oxygen will result in better carbon removal than a bubble containing only inert gas. While not wishing to be held to any theory, applicants believe that some oxygen in the bubble is necessary to enhance the kinetics of carbon removal at the low carbon concentrations prevailing.

Another important benefit of the process of this invention is the attainment of good bath mixing in the latter stages of decarburization. As the carbon content of the melt decreases there is a lessening of the carbon monoxide evolved and a consequent lessening of the agitation and bath mixing resulting from carbon monoxide bubbling through the melt. Good bath mixing is necessary for efficient refining of the melt. The process of this invention maintains good bath mixing throughout the latter portion of decarburization when there is a lessened carbon monoxide evolution by injecting inert gas into the melt and by lowering the oxygen lance to from 60 to 30 percent of the height it would normally be during the latter portion of the decarburization. The lance is lowered without encountering the danger of damage to the lance due, in part, to the reduction in the oxygen flow rate. As previously mentioned, it is preferred that the inert gas employed be a relatively heavy gas. This is because the heavier the gas the greater is the force with which it impacts the melt and therefore the greater is the agitation caused by the inert gas impact with the melt.

An unexpected and beneficial result of the process of this invention is the ability to employ a reblow procedure without the need for complicated procedures and while attaining excellent ultra low carbon results. Heretofore it has been considered necessary when producing low carbon steel to continue the decarburization process all the way to completion without any stops. This is because as the carbon content of the melt decreases to below about 0.1 weight percent, if the decarburization process is halted, there is not sufficient carbon left in the melt to react with oxygen to generate the required agitation necessary resulting in what is known in the art as a "dead bath". Reblowing such a melt is costly due to excessive metallic oxidation and the attendant high temperatures.

Unexpectedly applicants have found that when a melt is decarburized by the process of this invention and when the process is halted prior to the attainment of an ultra low carbon content in the melt, the melt can be easily and efficiently decarburized to an ultra low carbon content by simply carrying out or resuming the process of this invention. Thus a steel melt having a low but not an ultra low carbon content can be decarburized easily and efficiently by the process of this invention.

The following examples serve to further illustrate the process of this invention and to provide a comparison of the results obtained by the process of this invention with those obtained by conventional BOF practice. The examples are not intended to limit the scope of this invention in any way.

EXAMPLE 1

A 255 ton steel melt was decarburized to a carbon content less than about 0.06 percent by top blowing with pure oxygen in a BOP refining system in accordance with conventional BOP operating practices. The BOP refining system used employed an oxygen lance having a rating equivalent to a normal oxygen blowing flowrate of 26000 cubic feet per minute (CFM). The normal lance height in the latter portion of the decarburization was 6 feet. When the carbon content of the melt was estimated to be below 0.06 percent, argon, at a flowrate of 15000 CFM, was introduced into the oxygen lance where it was admixed with oxygen and was injected into the melt. Simultaneously with the argon introduction the oxygen flowrate through the lance was adjusted to 3000 CFM and the lance height was reduced to 3 feet. This injection of argon and oxygen was continued for 6 minutes after which the melt was analyzed. The results are shown in Table 1.

EXAMPLE 2

A 255 ton steel melt was decarburized using the same apparatus as used in Example 1 and using a procedure similar to that of Example 1 except that the oxygen flowrate, at the start of the argon injection, was reduced to only 14000 CFM and the lance height was not reduced but remained at 6 feet. The results are also shown in Table 1.

EXAMPLE 3

A 255 ton steel melt was decarburized using the same apparatus as used in Example 1 and using a procedure similar to that of Example 1 except that the oxygen flowrate, at the start of the argon injection, was reduced to zero. These results are also shown in Table 1.

EXAMPLE 4

A 255 ton steel melt was decarburized using the same apparatus as used in Example 1 and using a procedure similar to that of Example 1 except that the lance height was not reduced but remained at 6 feet throughout the decarburization. The results of the melt analysis are shown in Table 1.

EXAMPLE 5

A 255 ton steel melt was decarburized using the same apparatus as used in Example 1 and using a procedure similar to that of Example 1, except that the lance height was reduced to only 4 feet and the injection of argon and oxygen was continued for only 4 minutes. The results of the melt analysis are shown in Table 1.

TABLE 1

| | Ex. 1 | Ex. 2 | Ex. 3 | Ex. 4 | Ex. 5 |
|---|---|---|---|---|---|
| Carbon (wt %) | 0.014 | 0.025 | 0.029 | 0.029 | 0.035 |
| Slag FeO content (wt %) | 28.5 | 47 | 22 | 21 | 24.5 |
| Melt temperature (°F.) | 2990 | 3050 | — | 2895 | 2860 |

As is demonstrated in Example 1 the process of this invention effectively and efficiently produces ultra low carbon steel by the BOP technique without the need for any subsurface oxygen injection.

Examples 2–5 demonstrate that practice outside of the defined limitations of the process of this invention will not result in the efficient production of ultra low carbon steel.

In Example 2 the oxygen flowrate was not reduced to between 10 and 40 percent of the inert gas flowrate. The lance could not be lowered the required amount because of danger of damage to the lance. Ultra low carbon steel was not produced. Further the increased amount of oxygen introduced to the melt resulted in sharply increased metallic oxidation as shown by the slag FeO content, and an increased melt temperature.

In Example 3 the oxygen flowrate was reduced to zero. Although the metallic oxidation was reduced, ultra low carbon steel was not produced. The temperature of the melt in Example 3 was not available.

In Example 4 the oxygen flowrate was within the range defined by applicants' process but the lance was not lowered. Although the metallic oxidation was reduced, ultra low carbon steel was not produced.

In Example 5 the lance height was reduced to only 67 percent of the normal lance height. Although the metallic oxidation was reduced, ultra low carbon steel was not produced.

EXAMPLE 6

Example 6 demonstrates that the process of this invention can be employed to successfully and efficiently reblow a melt which has not been decarburized to below about 0.02 weight percent carbon.

A 255 ton steel melt was decarburized using the same apparatus as used in Example 1 and using a procedure similar to that of Example 1 except that the process was halted when the melt was decarburized to a carbon content of 0.022 weight percent. Thereafter the inert gas injection and the oxygen injection were restarted at the same flowrates as before the halt and the lance was kept at the same height as before the halt. The restarted inert gas and oxygen injection was continued for two minutes after which the melt was analyzed and found to have a carbon content of 0.015 weight percent.

We claim:

1. In a process for the production of low alloy steel comprising decarburizing a ferrous melt contained in a vessel by injecting oxygen through a lance into the melt from above the surface of the melt, wherein the lance height between the lance tip and the melt surface when there is a lessening of the carbon monoxide evolved is from about 30 to 40 oxygen nozzle diameters, the improvement whereby low alloy steel having an ultra low carbon content is produced comprising the steps of:

(a) injecting an inert gas into the melt from above the surface of the melt at a flow rate of from about 40 to 110 percent of the oxygen lance rating when the carbon content of the melt is less than about 0.06 weight percent;

(b) adjusting the flow of oxygen through the lance to be from about 10 to 40 percent of the inert gas flow rate;

(c) lowering the lance height to between about 30 to 60 percent of the normal lance height; and (d) continuing the injection of oxygen and inert gas into the melt until low alloy steel having the desired ultra low carbon content is produced.

2. The process of claim 1 wherein said inert gas is argon.

3. The process of claim 1 wherein said inert gas is injected into the melt by passing the inert gas through the oxygen lance.

4. The process of claim 3 wherein said inert gas is admixed with the oxygen in the oxygen lance.

5. The process of claim 1 wherein the oxygen flow is adjusted to be from about 15 to 25 percent of the inert gas flow rate.

6. The process of claim 1 wherein said carbon content of the melt in step (a) is less than about 0.06 weight percent but greater than about 0.03 weight percent.

7. The process of claim 1 wherein step (d) is carried out without interruption.

8. The process of claim 1 wherein step (d) is interrupted when the carbon content of the melt is greater than about 0.02 weight percent and thereafter restarted and completed by:

(1) injecting an inert gas into the melt from above the melt surface at a flow rate of from about 40 to 110 percent of the oxygen lance rating;

(2) injecting oxygen into the melt through the lance at a flow rate of from about 10 to 40 percent of the inert gas flowrate; and (3) continuing the injection of oxygen and inert gas into the melt at a lance height between 30 to 60 percent of the lance height until steel having the desired ultra low carbon content is produced.

* * * * *